US006631688B1

(12) United States Patent
Maag

(10) Patent No.: US 6,631,688 B1
(45) Date of Patent: Oct. 14, 2003

(54) QUILTING RACK FOR SEWING MACHINES

(76) Inventor: John D. Maag, MTI Management Ltd. 9808 Banyan Ct., Fort Wayne, IN (US) 46835-9441

( * ) Notice: Subject to any disclaimer, the term of this patent is extended or adjusted under 35 U.S.C. 154(b) by 0 days.

(21) Appl. No.: 10/128,347

(22) Filed: Apr. 24, 2002

(51) Int. Cl.[7] ..... B05B 11/00

(52) U.S. Cl. ..... 112/118

(58) Field of Search ..... 112/117, 118, 112/119, 102, 470.12, 470.13, 470.33, 303, 304, 305, 307, 475.07, 475.08; 38/102, 102.21, 102.4, 102.6, 102.8; 362/551, 553, 559

(56) References Cited

U.S. PATENT DOCUMENTS

| | | | | |
|---|---|---|---|---|
| 3,354,850 A | | 11/1967 | Story | |
| 3,442,234 A | * | 5/1969 | Cash | 112/118 |
| 3,680,507 A | | 8/1972 | Landoni | |
| 3,960,095 A | | 6/1976 | Story | |
| 4,192,241 A | | 3/1980 | Reed et al. | |
| 4,315,645 A | | 2/1982 | Knox | |
| 4,480,742 A | | 11/1984 | Muylle | |
| 4,665,638 A | | 5/1987 | Morton | |
| 4,669,405 A | | 6/1987 | Resta et al. | |
| 4,858,540 A | | 8/1989 | Resta et al. | |
| 4,953,483 A | | 9/1990 | Brower et al. | |
| 4,953,485 A | | 9/1990 | Brower et al. | |
| 4,969,410 A | | 11/1990 | Brower et al. | |
| 5,040,473 A | | 8/1991 | Zesch et al. | |
| 5,136,955 A | | 8/1992 | Resta et al. | |
| 5,226,250 A | | 7/1993 | Ulmer et al. | |
| 5,347,732 A | | 9/1994 | Padawer | |
| 5,617,802 A | | 4/1997 | Cash | |
| 5,685,250 A | | 11/1997 | Kaetterhenry et al. | |
| 5,711,236 A | * | 1/1998 | Badger | 112/117 |
| 5,870,840 A | | 2/1999 | Geils et al. | |
| 5,913,275 A | | 6/1999 | Flynn | |
| 5,913,277 A | | 6/1999 | Resta | |
| 6,151,816 A | | 11/2000 | Bagley | |

FOREIGN PATENT DOCUMENTS

| | | |
|---|---|---|
| EP | 0 275 017 A2 | 7/1988 |
| EP | 0 393 474 A1 | 10/1999 |

OTHER PUBLICATIONS

Printout of "Handi Quilter", printed on 03/35/2002 from www.handiquilter.com, 1 page, last updated Mar. 21, 2002. Printout of Handi Quilter trademark status as of Mar. 20, 2002. First use in commerce date: Oct. 31. 2000, 2 pages.

* cited by examiner

*Primary Examiner*—Ismael Izaguirre
(74) *Attorney, Agent, or Firm*—Richard C. Litman

(57) ABSTRACT

A quilting rack for sewing machines comprising a U-shaped rectangular metal frame supporting a wheeled bottom or queen carriage for side to side translation of a wheeled upper king carriage capable of forward and rearward translation of the sewing machine it is carrying. Three rollers supply, tension and load the quilt for sewing patterns guided by a laser pointer and a template. The quilting rack can be utilized without a sewing machine by mounting on a wall or shelf.

20 Claims, 17 Drawing Sheets

QUILTING RACK FOR SEWING MACHINES

BACKGROUND OF THE INVENTION

1. Field of the Invention

The present invention relates generally to quilting racks. More specifically, the invention is a tabletop quilting rack for use with a sewing machine. The quilting rack has a laser pointer guide, rollers to hold the raw material and the assembled quilt, a carriage, and an aluminum track on which the carriage rides.

2. Description of the Related Art

The related art of interest describes various quilting racks, but none discloses the present invention. There is a need for a quilting rack which is secured adjacent to a sewing machine which rides on a carriage of the rack. A laser pointer guides the tracing of a pattern on the quilt. The related art of interest will be discussed in the order of their perceived relevance to the present invention.

U.S. Pat. No. 4,192,241 issued on Mar. 11, 1980, to Donald K. Reed et al. describes an apparatus for quilting layered fabrics comprising a quilting frame including a sewing machine on a movable carriage. The sewing machine has an extensible sewing head for free-hand quilting. The apparatus has a large rectangular frame with six telescopic legs with three legs on each side. The sewing machine carriage is mounted by linear anti-friction bearings on parallel rails extending from side to side on the frame. Other parallel rails and anti-linear friction bearings extend transversely of the pattern and mount the linear bearings and carriage for movement longitudinally of the quilting fabric. A follower depends from the sewing machine carriage to engage and follow the pattern and controls movement of the carriage to conform to the pattern selected for quilting. The fabric and linear shafts may be adjusted and rotated to maintain the required tension on the material being quilted, and to assure a completed quilt free from wrinkles. The apparatus is distinguishable for requiring a sewing machine with a telescopic head and a large support for manufacturing purposes.

U.S. Pat. No. 5,913,275 issued on Jun. 22, 1999, to John F. Flynn describes a multiple use quilting frame comprising a quilting frame for hand quilting or machine sewing quilting. The frame has three parallel spaced rods individually rotated and locked in a rotated position by engaging splines on the ends of the rods and on the frame ends by the use of a screw threaded knob-type wing nut. The top and bottom layers of the quilt are attached to certain rods and batting inserted from a fourth rod. The three quilt layers are attached to and wound on a third rod, and manipulated for either hand stitching or machine sewing with the rods maintaining the quilt in a taut condition. The device is distinguishable for requiring the addition of batting from a roll between the two rolls of the quilt layers.

Printout of "Handi Quilter", printed on Mar. 25, 2002, from www.handiquilter.com, 1 page, last updated Mar. 21, 2002, and a printout of Handi Quilter trademark status as of Mar. 20, 2002, with first Use in Commerce Date: Oct. 31, 2000, 2pages. The first source describes the clamping of the Handi Quilter apparatus to a table, and setting the personal sewing machine to a gliding carriage. Telescoping poles allows quilts from 30 inches to Queen bed size quilts to be quilted. The unit is compact, portable and lightweight. The apparatus is dismantled by removing end bolts for storage. The apparatus is distinguishable for requiring a plastic track that is pieced together, taped to the table, but lacks attachment of the side supports. The apparatus requires retrackable buttons, and pieces of material wrapped around the tube supports to attach to the quilting material. The apparatus lacks a laser pointer.

Printout of "Pennywinkle Valley Ranch", printed on Mar. 25, 2002 from www.pennywinklevalleyranch.com, as best understood describes a home quilting system using a domestic sewing machine mounted on a lower rectangular table top with a second large movable rectangular table top of equal size above it holding the quilt material on presumed rollers.

U.S. Pat. No. 4,665,638 issued on May 19, 1987, to Oscar E. Morton describes a quilting frame designed to stretch and hold material while hand stitching bed quilts. A pair of legs that are adjustable in height and that are free-standing when three rods for holding quilt material are removed from the frame. A hand crank is provided for rotating the rods and a locking device is available for prevention of rod rotation. Tensioning is provided for by a horizontal tensioning mechanism pivotal on link rods attached to one of a pair of horizontal rods of the frame. The device is distinguishable for being limited to hand stitching.

U.S. Pat. No. 4,480,742 issued on Nov. 6, 1984, to Wilfried E. Muylle describes a spreading conveyor apparatus comprising four rollers, an endless air-permeable laterally stretchable spreading band, endless air-permeable supporting band means within the path of the spreading band, and a suction box within the loop of the suction band and having a perforated wall in contact with the inner side of the supporting band means along a portion of its path. The apparatus is distinguishable for being limited to a spreading conveyor.

U.S. Pat. No. 4,315,645 issued on Feb. 16, 1982, to Billy B. Knox describes a rug hooking stand comprising a pair of upright supports for a top supply roller, a mediate roller extending outward on a V-shaped strut, and a pickup roller in line with the first roller. The stand is distinguishable for being limited to a three-roller structure placed in a V-shaped path.

U.S. Pat. No. 3,354,850 issued on Nov. 28, 1967, to Wayne G. Story describes a feed control mechanism for a quilting machine arrangement comprising a means for driving the sewing and workpiece feed mechanisms from a common power source and including a guide mechanism with a differential gearing arrangement to compensate for the relative movement between the feed drive and the feed control mechanisms to provide a uniform speed rate for the feed drive mechanism relative to the speed of the sewing mechanism to insure uniformity of in the length of stitches of the sewing machine. The machine is distinguishable for being limited to a manufacturing process.

U.S. Pat. No. 3,680,507 issued on Aug. 1, 1972, to Giannino Landoni describes a multi-needle quilting machine for performing stitching along different paths, and having the carriage imparting a transverse movement to the quilting material achieved by gear coupling between the main shaft and the drawing roller axle to permit higher velocities of the quilting operation. The machine is distinguishable for requiring gearing.

U.S. Pat. No. 3,960,095 issued on Jun. 1, 1976, to Wayne G. Story describes an automatic quilting machine comprising a frame, a workpiece holding carriage mounted on the frame for universal movement, means for moving the carriage, a sewing mechanism, means for applying tension on the material, and means for automatically operating the carriage moving means, the sewing mechanism and the tensioning means. The machine is distinguishable for being limited to manufacturing quilts.

U.S. Pat. No. 4,669,405 issued on Jun. 2, 1987; U.S. Pat. No. 4,858,540 issued on Aug. 22, 1989; U.S. Pat. No. 5,136,955 issued on Aug. 11, 1992; U.S. Pat. No. 5,913,277 issued on Jun. 22, 1999; to Rodolfo Resta et al. describe an apparatus for cutting and hemming quilts. The apparatuses are distinguishable for being limited to manufacturing quilts.

U.S. Pat. No. 4,953,485 issued on Sep. 4, 1990, and U.S. Pat. No. 4,969,410 issued on Nov. 13, 1990, to David Brower et al. describe an automatic quilting machine for specialized quilting of patterns which can be created by utilizing computer graphics in conjunction with a reprogrammable computer which can be controlled by a remote joystick and monitored by a video screen. The system is distinguishable for being limited to a manufacturing quilting apparatus and method.

U.S. Pat. No. 5,040,473 issued on Aug. 20, 1991, to Manfred Zesch et al. describes a method and apparatus for processing textile material webs such as quilts to obtain simultaneously sewn bands or ribbons and cover the entire width of the quilt material. The apparatus is distinguishable for being limited to a manufacturing quilting machine.

U.S. Pat. No. 5,617,802 issued on Apr. 8, 1997, to David R. Cash describes a multi-needle border machine having folders employable in mattress manufacturing by converting to simultaneously produce up to three border pieces. The machine is distinguishable for being limited to a manufacturing process.

U.S. Pat. No. 5,685,250 issued on Nov. 11, 1997, to Jeff Kaetterhenry et al. describes a quilting method and apparatus for making quilts from unquilted comforter bags. The apparatus is distinguishable for being limited to an assembly line type apparatus.

U.S. Pat. No. 6,151,816 issued on Nov. 28, 2000, to Jim Bagley describes a portable quilting frame assembly with a Z-structure profile comprising two complementary support structures, each of which includes a base member, an elevation member, and a fulcrum member. The two complementary support structures are coupled by a cross member. Coupled to each of the fulcrum members is a rail assembly comprising two complementary rail brace members which hold three rails upon which components of the quilt are separately disposed. The three rails consist of a take-up rail and two supply rails having gearing, i.e., ratchet and pawl, to maintain tension of the quilt between rails. The apparatus is distinguishable for being limited to hand-quilting.

U.S. Pat. No. 5,870,840 issued on Feb. 16, 1999, to Neil Geils et al. describes a stitchery scroll frame and stand for making quilts or rugs. The structure has front and rear rollers extending between two upright rectangular side frames. The scroll frame is distinguishable for being limited to two rollers.

U.S. Pat. No. 5,347,732 issued on Sep. 20, 1994, to Robert S. Padawer describes a needlework scroll frame including slots and two fabric engaging rods. The frame is distinguishable for being limited to only two rollers.

U.S. Pat. No. 5,226,250 issued on Jul. 13, 1993, to Larry Ulmer et al. describes a portable, collapsible craftwork or quilting frame for tensioning textiles comprising a frame having parallel ends and sides supported by parallel legs on leg end plates and feet. The frame is distinguishable for being limited to a rollerless frame.

E.P.O. Patent Application No. 0 275 017 A2 published on Jul. 20, 1988, for Mario Resta et al. describes a quilting machine with an adjustable-length cloth-holder cylinder rotatable about a horizontal axis. The machine is distinguishable for requiring a rotatable cloth-holder cylinder.

E.P.O. Patent Application No. 0 393 474 A1 published on Oct. 10, 1990, for Mario Resta et al. describes a quilting machine with a stationary cloth-holder frame and sewing heads movable in orthogonal directions. The machine is distinguishable for requiring a plurality of movable sewing heads.

None of the above inventions and patents, taken either singularly or in combination, is seen to describe the instant invention as claimed. Thus, a quilting rack for sewing machines solving the aforementioned problems is desired.

SUMMARY OF THE INVENTION

The present invention is directed to an efficient and reliable quilting rack device integrated with a domestic sewing machine to enable the accurate free-motion machine quilting of one or two layers of fabric material including optional batting between the two fabric layers. One can stitch in any direction, and feel artistically free to make free-hand and stippling designs. Since, the sewing machine moves on its movable rack, there is less stress using this device than pulling the material through a stationary sewing machine. A laser light pointer element in front of the sewing machine on the top plate is provided for tracing patterns from a template placed on the right of the sewing machine. The quilting rack device has a horizontal rectangular aluminum frame with a lower carriage on four wheels travelling from one end to the other. A second carriage on four wheels translates forward and backward while carrying the sewing machine as a rider, and are not clamped to a table. A pair of upright aluminum side angle pieces on each side of the base forward of the sewing machine support plastic racks which hold three metal tubes. The front tube No. 1 rolls clockwise to roll up the unrolling fabric sheets fed from the middle roller No. 2 (top sheet) rotating clockwise and the rear roller No. 3 (bottom sheet) rotating counter-clockwise. There are stops on the lower carriage to prevent the sewing machine from rolling off. The domestic sewing machine can be a pattern programming machine, but the invention prefers manual patterning. Two metal tubes or rollers are arranged to enable the material to roll over with improved support and minimum sag. Hitch pin clips are utilized to hold the metal tubes in place. Slots are formed in the tube supports for an elastic band to slide through to hold the quilt snug from side to side. The elastic band has a snap fastener on one end for fastening to the tube support slot. The quilting rack device can be attached to a wall by brackets and used without a sewing machine and its carriages to free-hand stitch the quilt design.

Accordingly, it is a principal object of the invention to provide a quilting rack device which is combined with a domestic sewing machine on its own movable track to sew free-hand a quilting pattern on a quilt precursor fabric sheet.

It is another object of the invention to provide a quilting rack device having a laser light pointer for tracing patterns from a template.

It is a further object of the invention to provide a quilting rack device having a second carriage translating the sewing machine forward and backward.

Still another object of the invention is to provide a quilting rack device which can be mounted on a wall without using a sewing machine and the carriages by free-hand stitching the quilt design.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
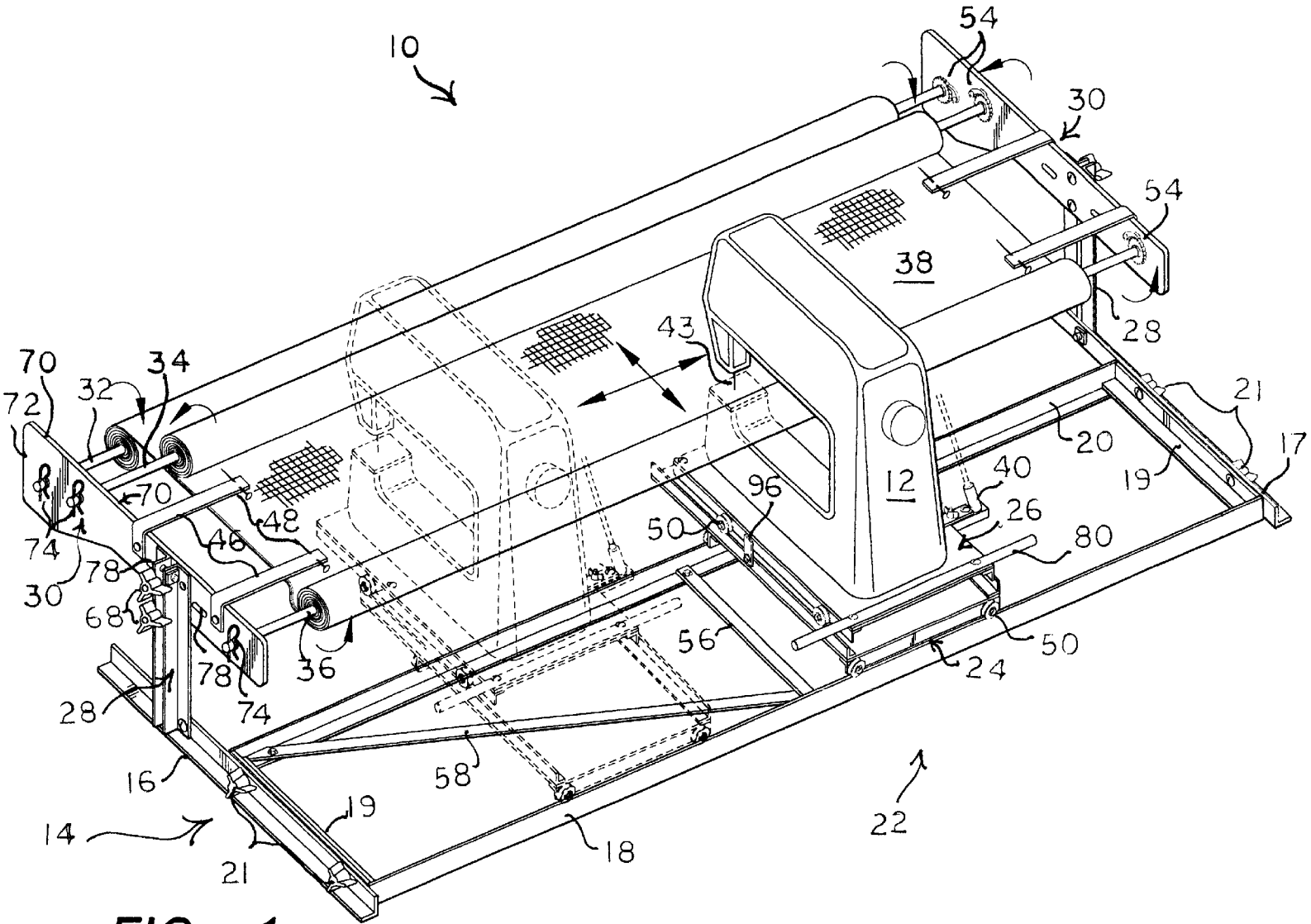
FIG. 1 is an environmental, front perspective view of a quilting rack and a sewing machine in a second movement shown in shadow according to the present invention.
Figure 19A:
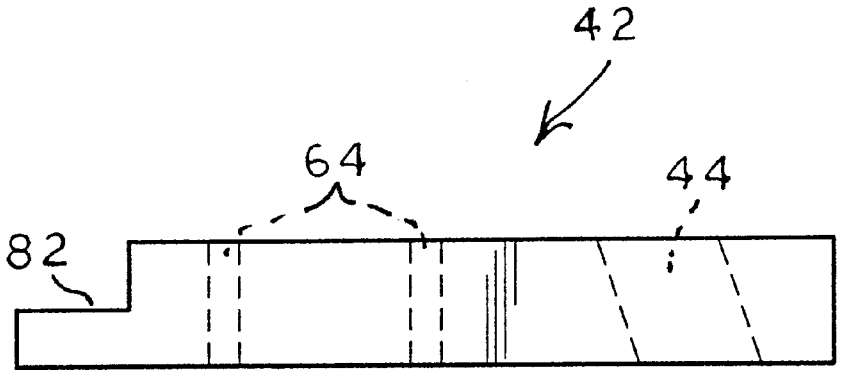
FIG. 19A is a side elevational view of the laser pointer mount.
Figure 19B:
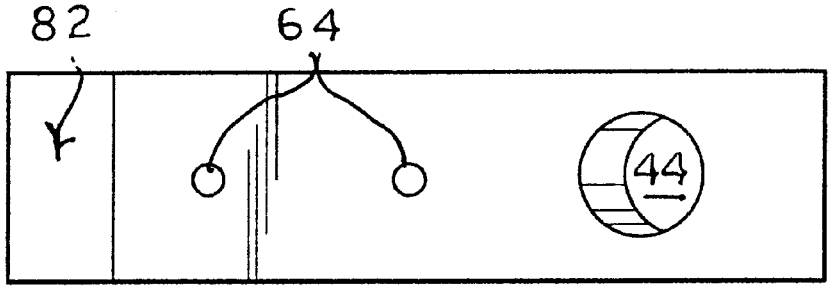
FIG. 19B is a top plan view of the laser pointer mount.
Figure 19C:
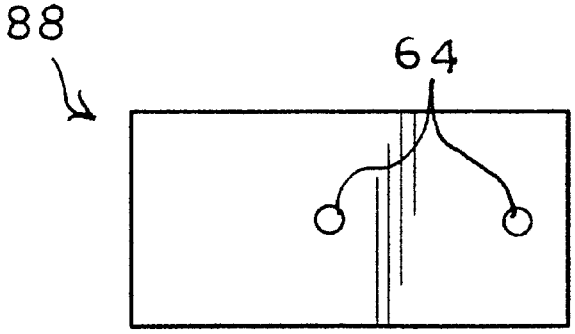
FIG. 19C is a top plan view of the locking bracket for the laser pointer mount.

The present invention is directed to a quilting rack 10 illustrated in FIG. 1 for sewing machines 12 preferably, but can be used without the sewing machine by positioning the rack 10 on a shelf (not shown). The rack 10 has a U-shaped metal frame 14 having a pair of extending side rails 16 supporting a front rail 18 and a rear rail 20 to form a rectangular metal frame 22. The side rails 16 are actually a queen base extension rail 17 combined with a king base extension rail 19 (hidden inside) adjusted by a knobbed screw 21 to accommodate different lengths of exposed combined fabric sheet material to be stitched together. A first rectangular wheeled carriage or queen carriage 24 translatable from side to side from the extending side rails 16 on the rectangular metal frame 22. A second rectangular wheeled carriage or king carriage 26 translatable forward and backward on the first wheeled carriage 24 supports the sewing machine 12. Each of the pair of extending side rails 16 supports an upright roller support element 28 which has a roller support arm 30 horizontally arranged perpendicularly to each upright roller support element 28. A set of three rollers, i.e., 32 (rear), 34 (middle) and 36 (front), extend between the roller support arms 30 to supply, tension and load, respectively, to a quiltable fabric sheet material 38 comprising two fabric sheets with or without an intermediate batting layer to be quilted. The rollers are formed from rubber or flexible plastic tubes on aluminum tubes. Each of the rollers are rotatable only in one direction. A laser pointer device 40 located on the right side of the second wheeled carriage (king) 26 and positioned by a laser pointer mounting element 42 (FIGS. 19A–19C) to incline slightly toward the sewing needle 43 by an inclined throughbore 44. A hand-made or commercially available pattern stencil (not shown) is used to mark a pattern on the quiltable fabric sheets 38, whereby the quiltable fabric sheet material 38 can be patterned by the sewing machine 12 following the illuminated stencilled pattern on the movable quiltable fabric sheet material 38.

Each horizontal roller support arm 30 is adjustable in height on each upright roller support element 28, and has a pair of straps 46 for tensioning the quiltable fabric sheet material 38 from side to side with pins 48 as seen in FIG. 1. It should be noted that the pins 48 are used only temporarily to hold the sheet material 38 taut until the stitching is completed for that segment of the fabric sheet material 38.

The first rectangular wheeled queen carriage 24 has four grooved wheels 50 with two wheels on each side traversing on top of the parallel front rail 18 and the rear rail 20 attached to the front portion of the pair of extending side rails 16. The second rectangular wheeled king carriage 26 has four grooved wheels or sheaves 50 with two wheels on each side traversing on top of the parallel side rails 52 of the first rectangular wheeled queen carriage 24.

The unidirectional rotations of the three rollers will be described now with reference to FIG. 1 from the front of the apparatus. The rear supply roller 32 rotates only in a counter-clockwise direction as depicted by a directional arrow, where as the loading roller 36 and the tension or intermediate roller 34 rotate only in a clockwise direction. The unidirectional rotation of the three rollers are controlled by a set 54 of a pawl and a gear wheel (serrated in a direction to hold the pawl) on one end of each roller. The two sheet materials 38 from the clockwise rotating roller 32 and the counter-clockwise rotating roller 34 come together with an optional batting layer (not shown) already installed on one or both of the unrolling sheets, and are rolled up counter-clockwise on the loading roller 36.

Figure 2:
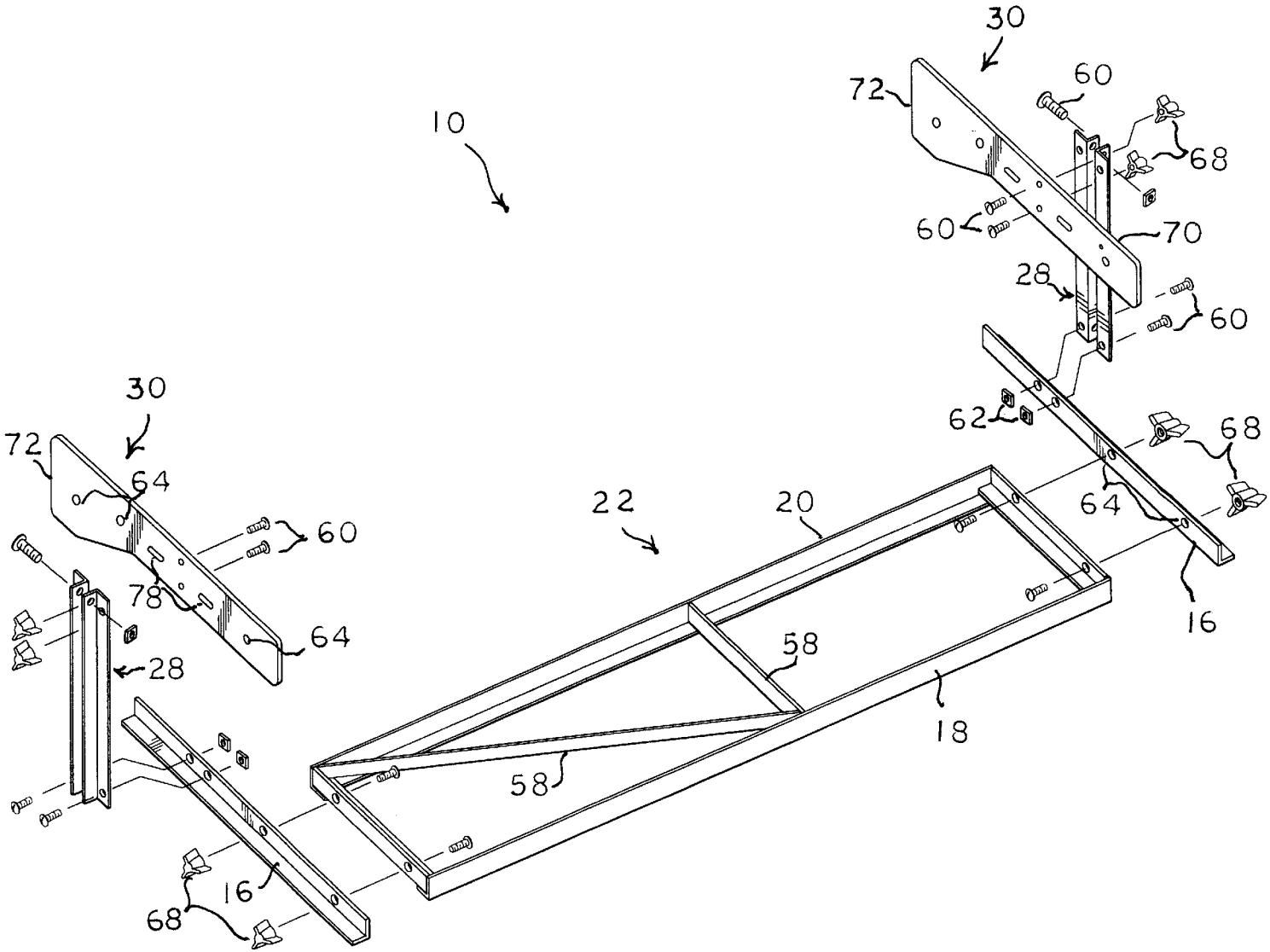
FIG. 2 is an exploded front perspective view of the main track frame and upright roller supports.
Figure 3:
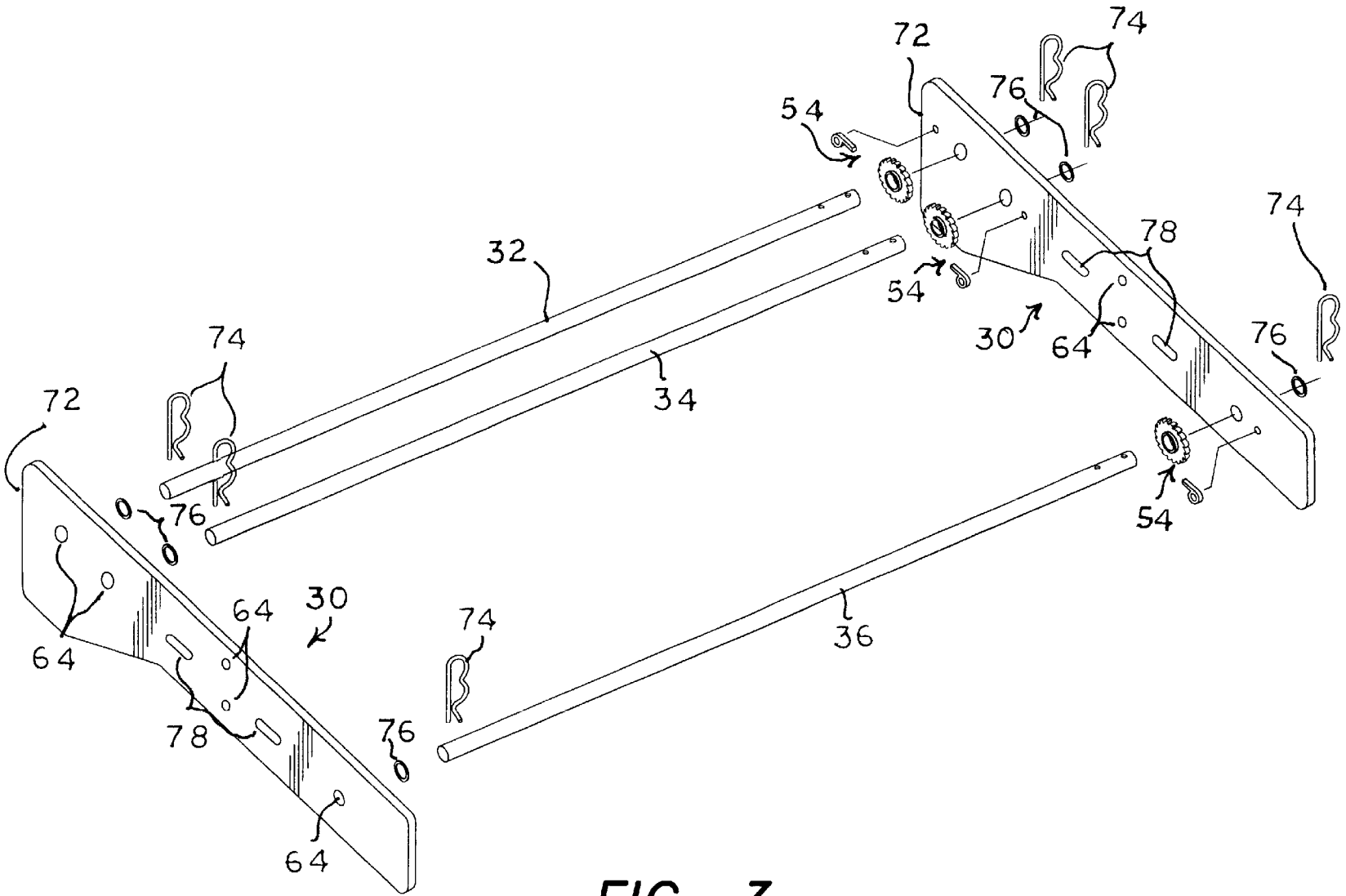
FIG. 3 is an exploded front perspective view of the three roller rods attached to the upright roller support arms with each roller rod end having a pawl and ratchet set for unidirectional roller rotation.

In FIGS. 1 and 2, the rectangular metal frame 22 has a welded mid-brace 56 and a diagonal brace 58 formed of unflanged metal strips for reinforcing the frame 22. The pair of right-angled extending side rails 16 are secured to the narrow ends of metal frame 22 by knobbed set screws 21 through apertures 64. The side rails 16 in turn support the upright roller support element 28 which is actually a composite of two flanged rails 66 providing a space for a pair of wing nuts 68 to hold the horizontal roller support arm 30 between the flanges at a predetermined adjustable height.

Figure 6:
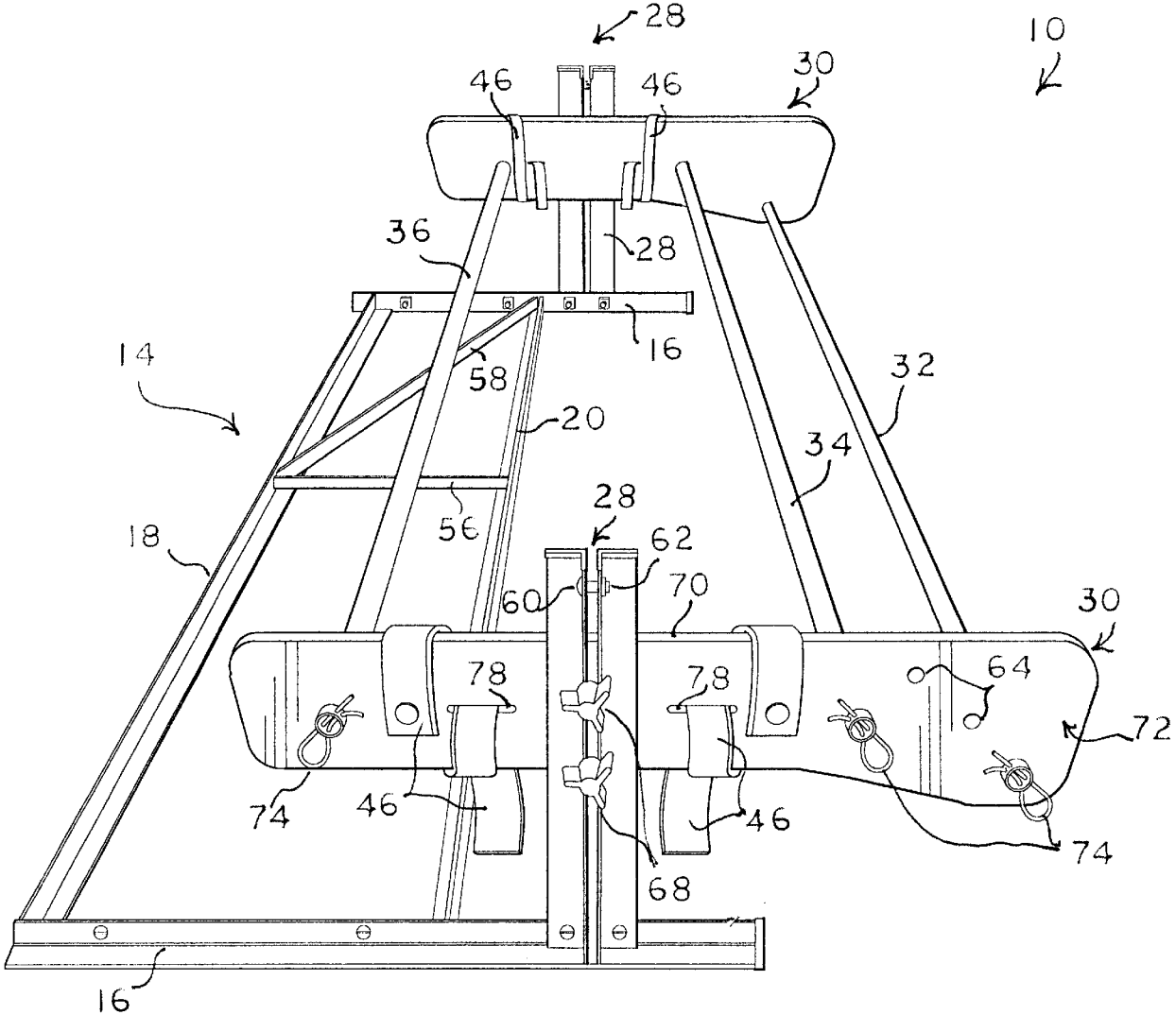
FIG. 6 is a right side perspective view of the adjustable height roller rod support arms with the tie straps on the base frame.

Returning to a more complete description of the upright roller support element 28 depicted in FIGS. 2 and 6, and the is horizontal roller support arm 30 illustrated in FIGS. 2, 3, 6, and 18, the horizontal roller support arm 30 has a straight upper surface 70 and enlarged rear head portion 72 for supporting the three rollers 32, 34 and 36 in fixed straight horizontal position with wire clips 74 outside the roller support arm 30 in apertures 64 of the roller ends and bushings 76 inside the enlarged apertures 78 of the support arm 30.

The advantage of adjusting the level of each horizontal roller support arm 30 without twisting on each upright support element 28 with the two in-line wing nuts 68 enables the sewer to position any sewing machine 12 to the enabling position for proper stitching of the fabric sheet material 38.

The wooden or metal rod 80 at the front edge of the second rectangular wheeled carriage or king carriage 26 and extending past its sides enables control of the second carriage forward and rearward.

Figure 4:
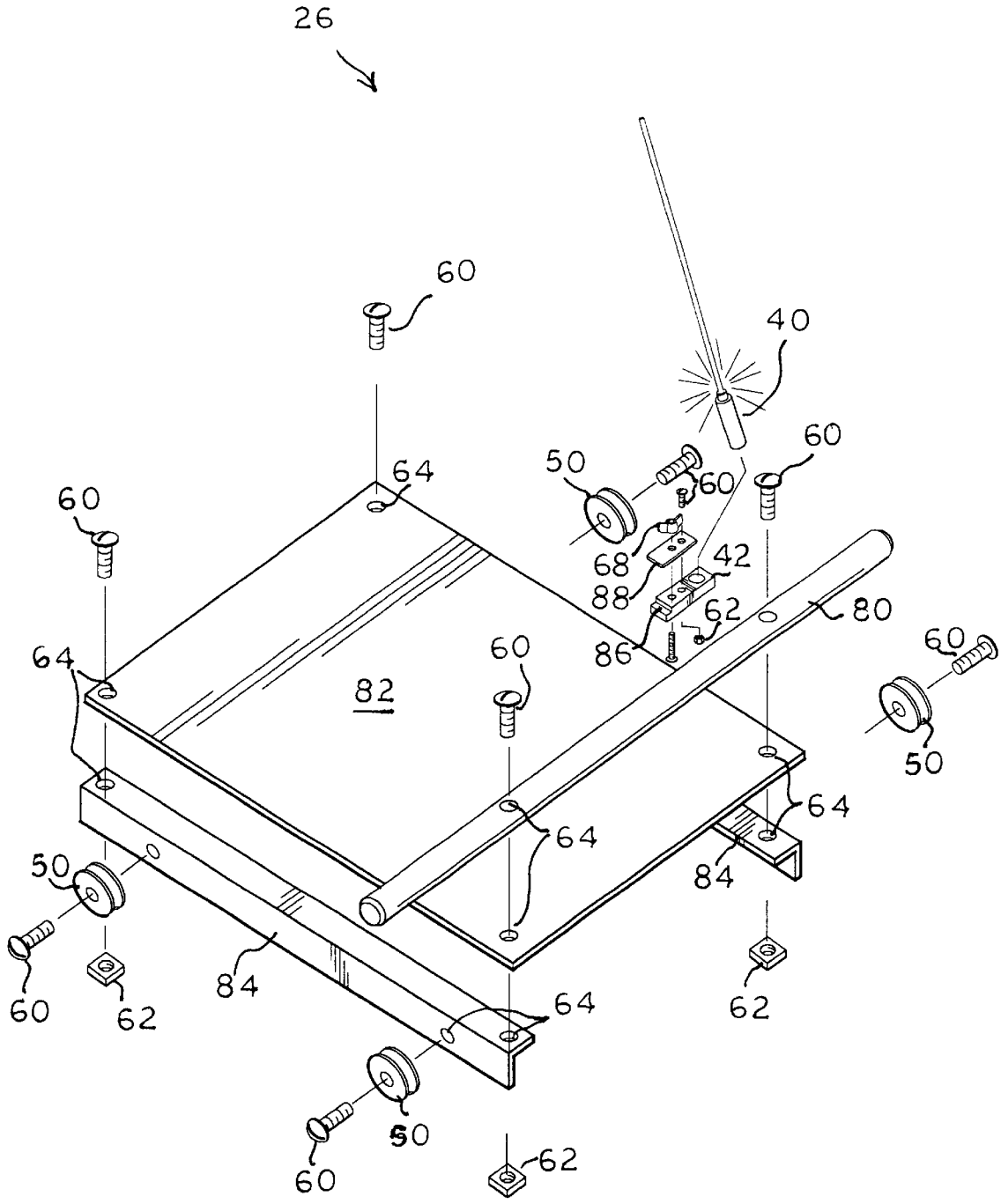
FIG. 4 is an exploded perspective view of the wheeled upper carriage which translates forward and backward on a lower carriage.
Figure 5:
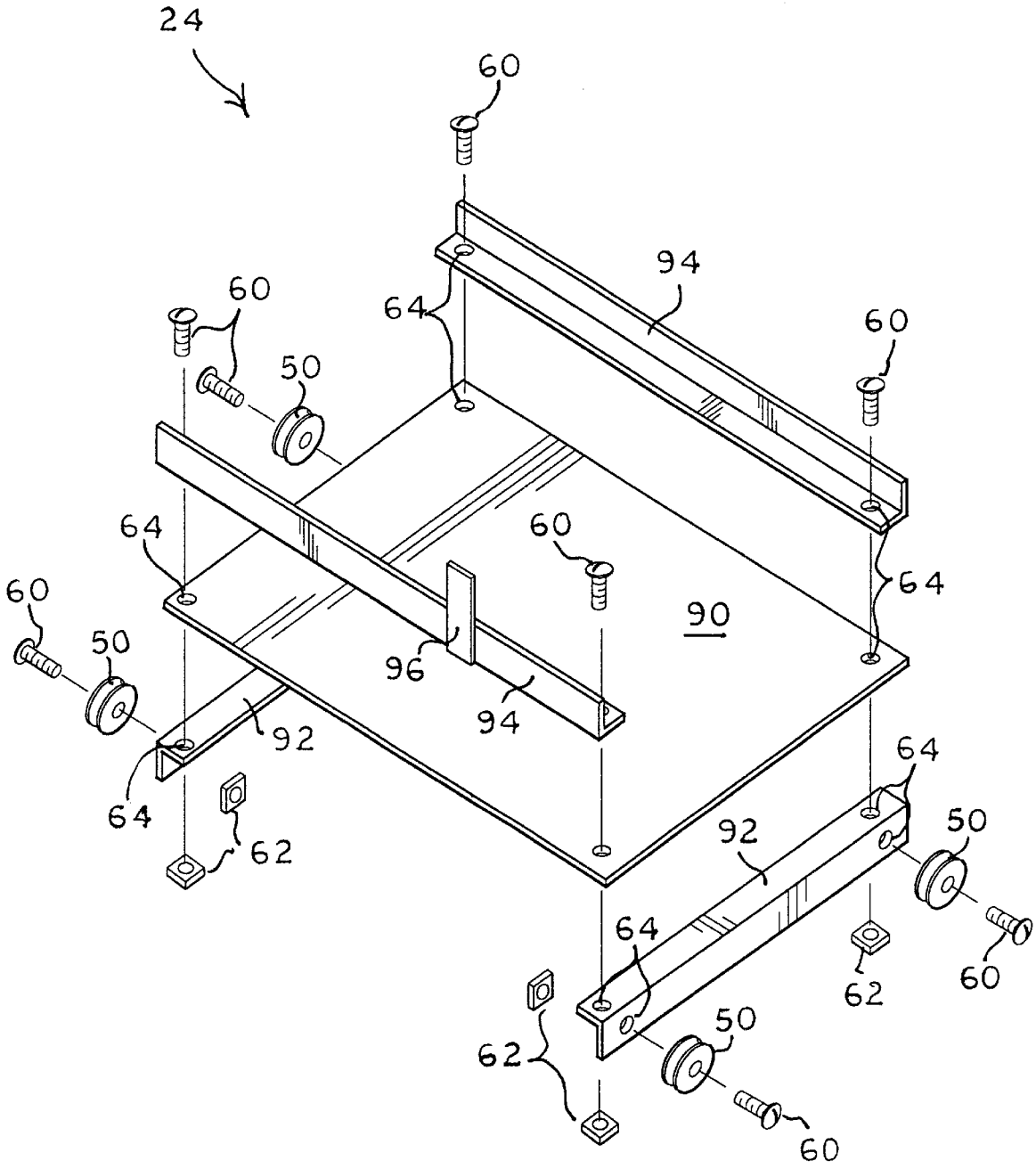
FIG. 5 is an exploded perspective view of the wheeled lower carriage which translates from side to side on the main track frame.

FIGS. 4 and 5 depict an exploded view of the smaller top king carriage 26 and the lower queen carriage 24, respectively. The heavy duty white polyethylene rectangular king plate 82 in FIG. 4 has a parallel pair of bottom aluminum angle rails 84 shown also in FIGS. 14A (side view) and 14B (top view) with apertures 64 for bolting to the corners of the king plate 82 with bolts 60 and nuts 62, and the wood or metal control rod 80 in front. The four grooved wheels or sheaves 50 are attached to the angle rails 84 by similar nuts and bolts into apertures 64. In FIG. 4, the laser pointer device 40 is mounted in the inclined throughbore 44 of the laser mounting element 42 as discussed earlier in FIGS. 19A and 19B. The mounting element 42 has a notch 86 at the end opposite the laser mounting throughbore 44 in its upper surface to fit against the side and bottom of the king plate 82 and held there by the doubly apertured rectangular plate 88 of FIG. 19C on top of the edge of king plate 82 by a wing nut 68 and a bolt 60 in the proximate aperture for easier loosening for movement of the mounting element 42 to another position. The distal fastener is a bolt 60 and nut 62.

The queen plate 90 in FIG. 5 is made of similar material and is a larger rectangular plate than the king plate 82 (see FIGS. 17A and 17B) with its pair of parallel bottom side rails 92 attached by bolts 60 and nuts 62 which also fasten the upper pair of parallel side rails 94 which are perpendicular to the bottom side rails 92. The upper rails 94 have a welded stop plate 96 to prevent the rear wheels or sheaves 50 of the king plate 82 with the sewing machine 12 from moving further back off the upper rails 94. The lower rails 92 support the queen plate 90 on four wheels 50 on bolts 60 with nuts 62.

Figure 7A:
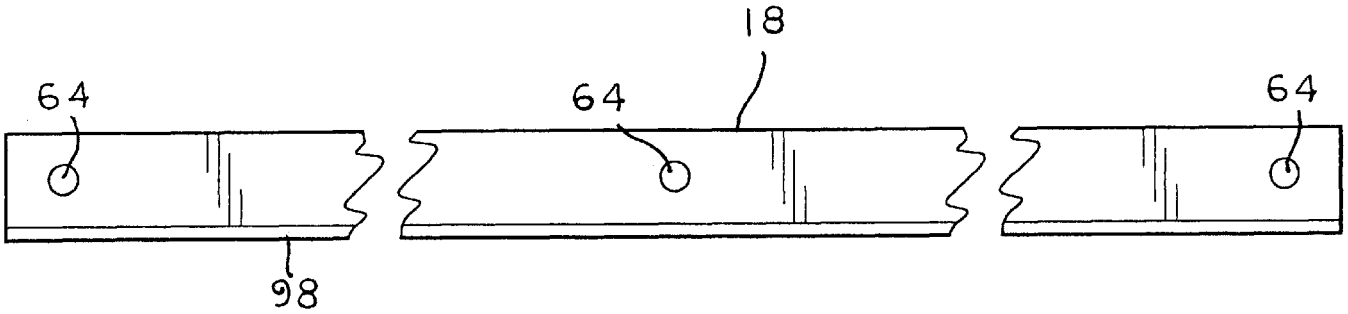
FIG. 7A is a side elevational view of one of a pair of either (1) a main track frame, (2) king frame or upper extension side pieces, or (3) queen frame or lower extension side pieces.
Figure 7B:
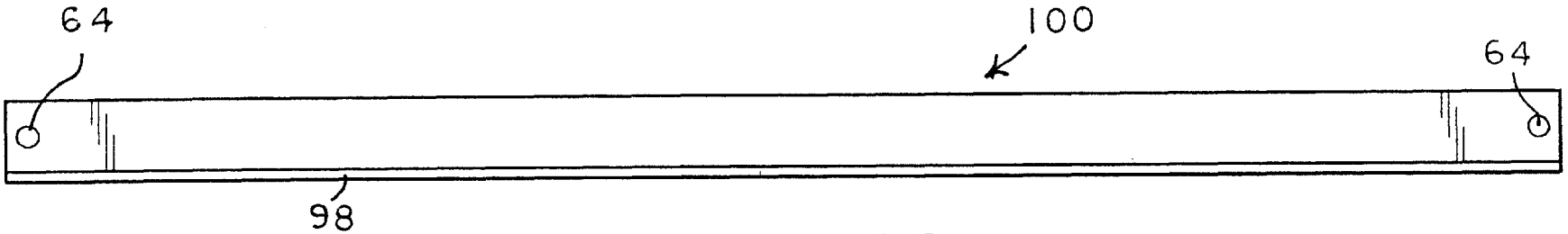
FIG. 7B is a top plan view of one of a pair of the king frame or upper extension end pieces.
Figure 7C:
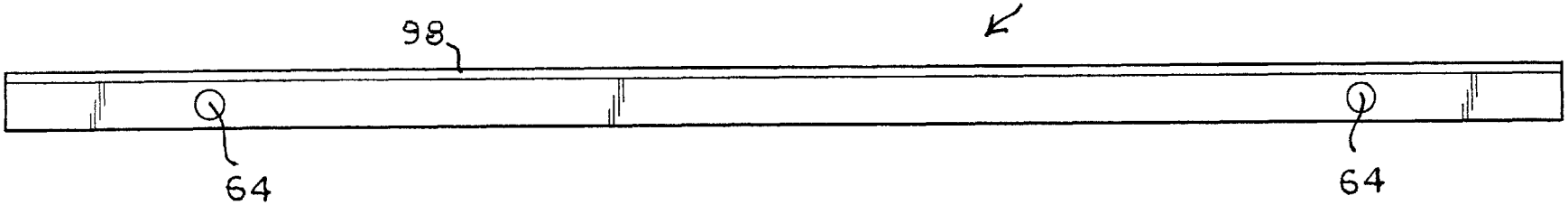
FIG. 7C is a side elevational view of the FIG. 7B end piece.

Turning to FIGS. 7A–C, one of the pair of longer main track frame sides 18 and 20 approximately 66 inches in length is depicted in FIG. 7A with flanges 98 on the bottom and outside apertures 64 for joining with the pair of flanged end pieces 100 with one end piece illustrated in a side view in FIG. 7B and in a top view in FIG. 7C. The large apertures 102 in FIG. 7B are for the knobbed adjusting screws 21 to extend the side rails 16 of the frame 14. The smaller apertures 64 proximate the ends of flanged end pieces 100 and the main frame sides 18 are for joining the main track frame sides 18 to the end pieces 100 to form the rectangular metal frame 22 for the carriages 24 and 26.

Figure 8A:
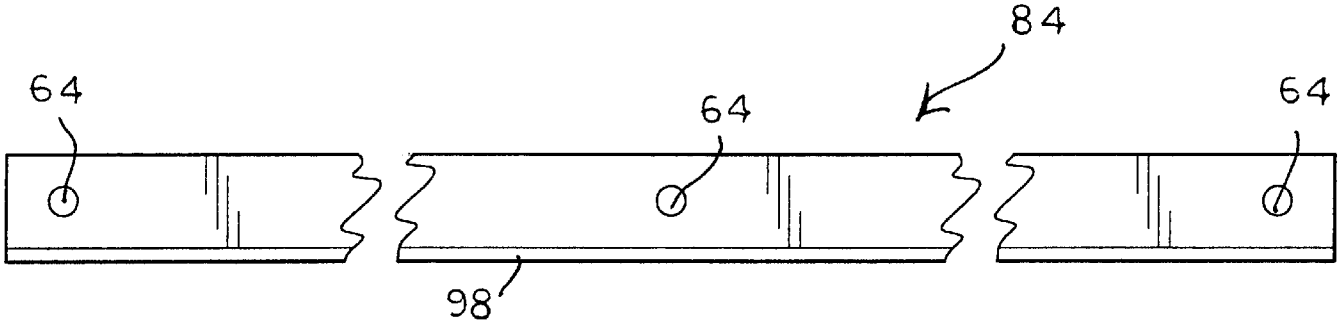
FIG. 8A is a side elevational view of one of a pair of queen frame or king frame (shorter) lower extension side pieces.
Figure 8B:
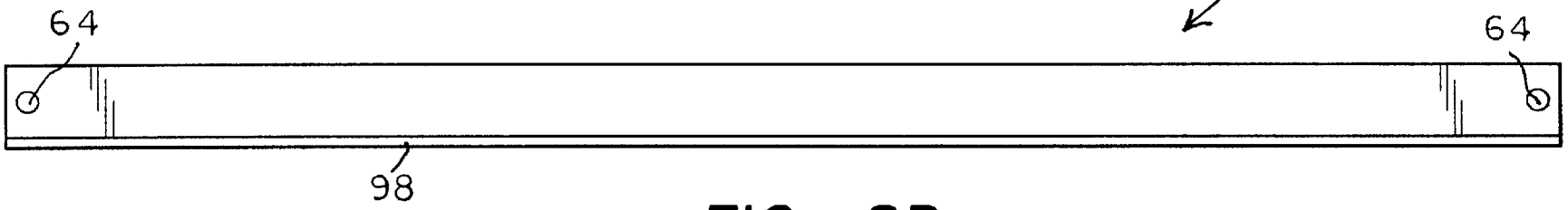
FIG. 8B is a top plan view of one of a pair of the queen frame or lower extension end pieces.
Figure 8C:
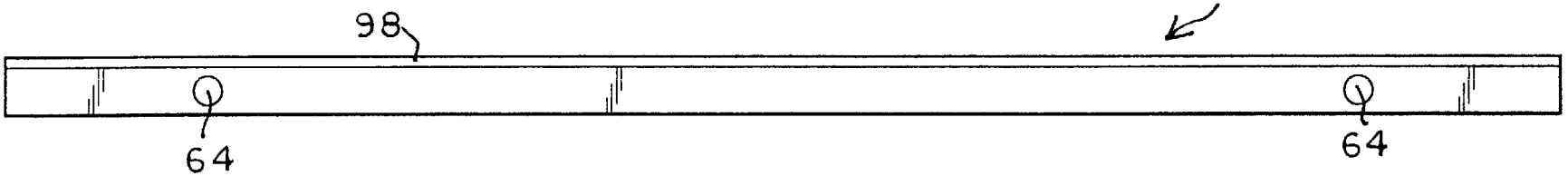
FIG. 8C is a side elevational view of the FIG. 8B end piece.

FIGS. 8A–C are representative of the king extension pair of bottom angle rails 84 in FIG. 4 and the shorter upper queen extension pair of the upper angle rails 94 and the shorter pair of equal sized bottom rails 92 with larger apertures 78 in FIG. 5.

Figure 9:
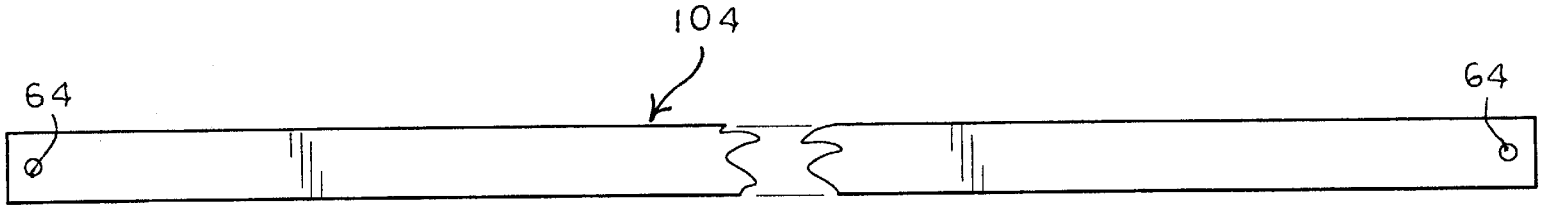
FIG. 9 is a side elevational view of a cross brace representative of cross braces of the main frame, the queen frame and the king frame. The main cross braces for the queen frame and the king frame are located underneath the queen and king plates.

FIG. 9 depicts cross braces 104 of different lengths for the rectangular frame 22 (FIG. 1) with apertures 64, for the queen carriage 24 (hidden under the plate), and for the king carriage 26 (hidden under the plate) which are fastened to the flanges of the aforementioned angle elements.

Figure 10B:
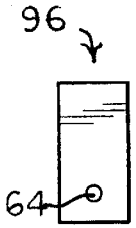
FIG. 10B is a side elevational view of the stop piece.
Figure 10A:
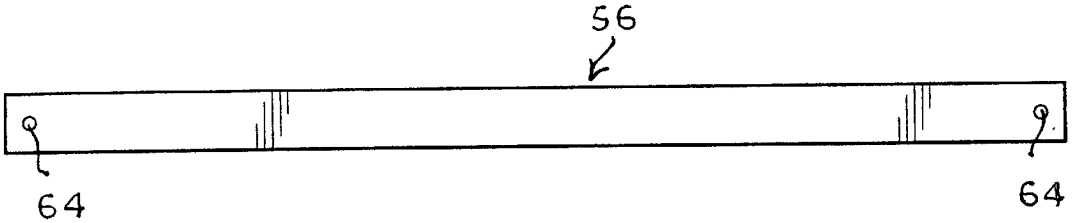
FIG. 10A is a side elevational view of the main spacer piece.
Figure 11:
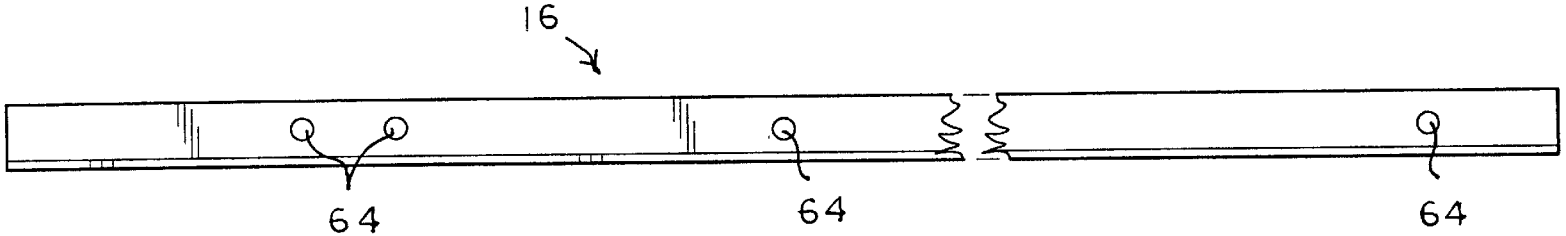
FIG. 11 is a side elevational view of the left side support of the base frame.
Figure 12B:
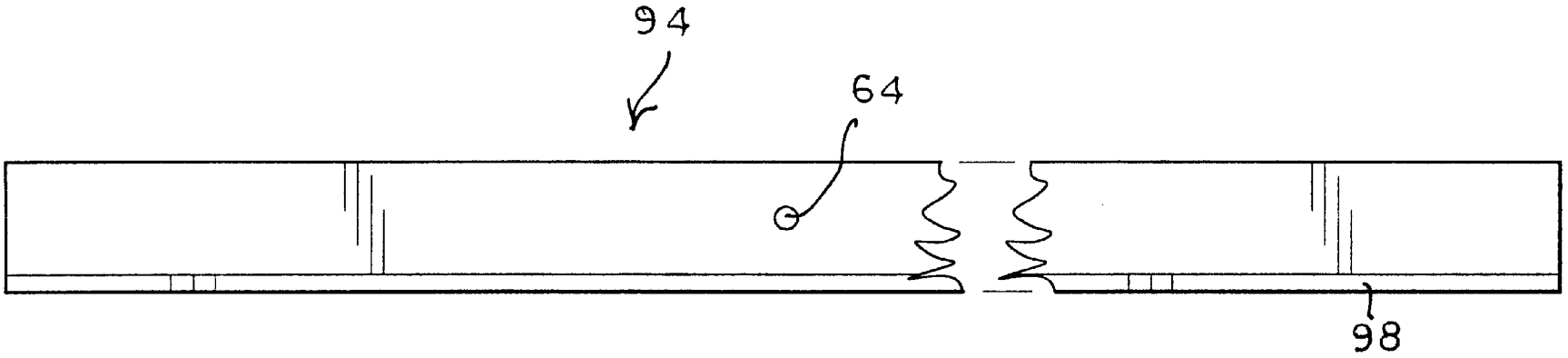
FIG. 12B is a top plan view of the top rail for the bottom plate.
Figure 12A:
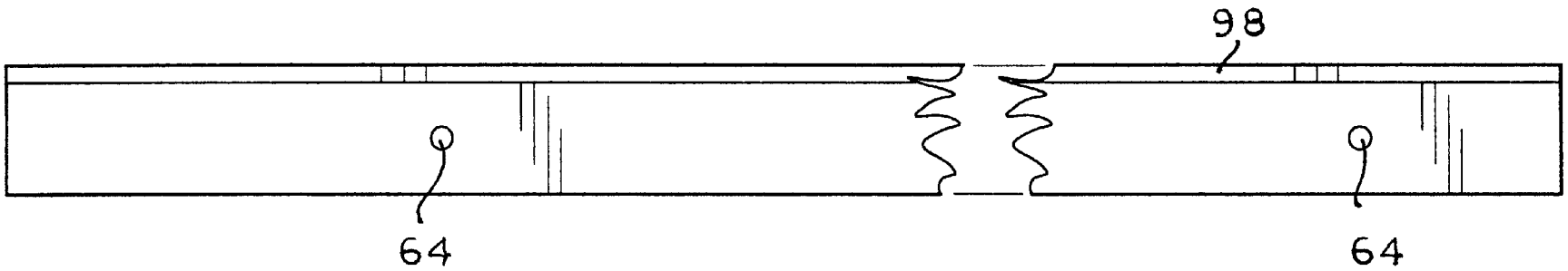
FIG. 12A is a side elevational view of the top rail for the bottom plate.
Figure 13A:
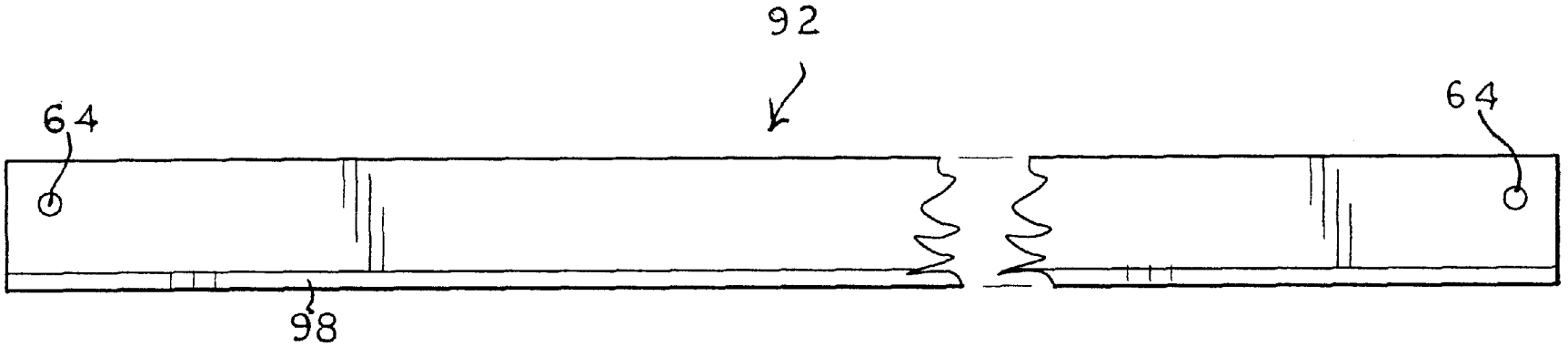
FIG. 13A is a top plan view of the bottom rail for the bottom or queen plate.
Figure 13B:
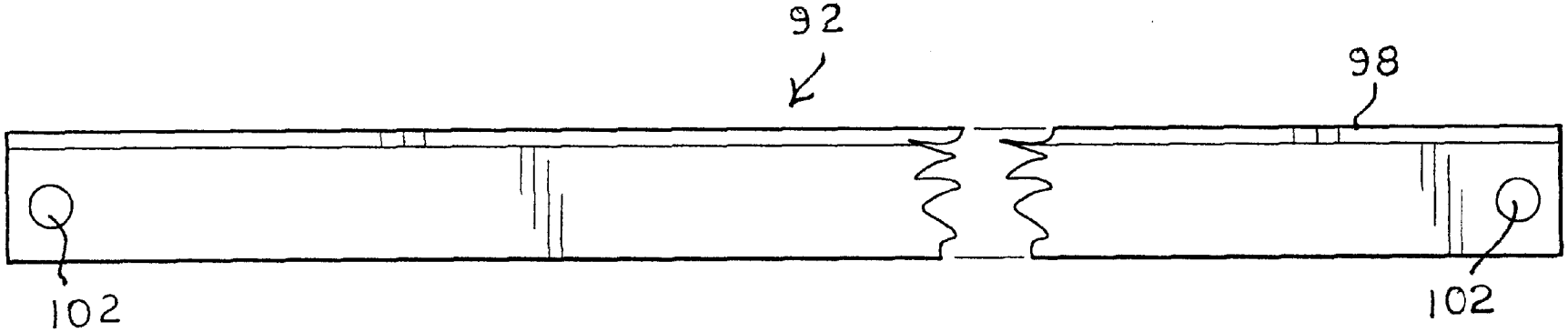
FIG. 13B is a side elevational view of the bottom rail for the bottom or queen plate.
Figure 14B:
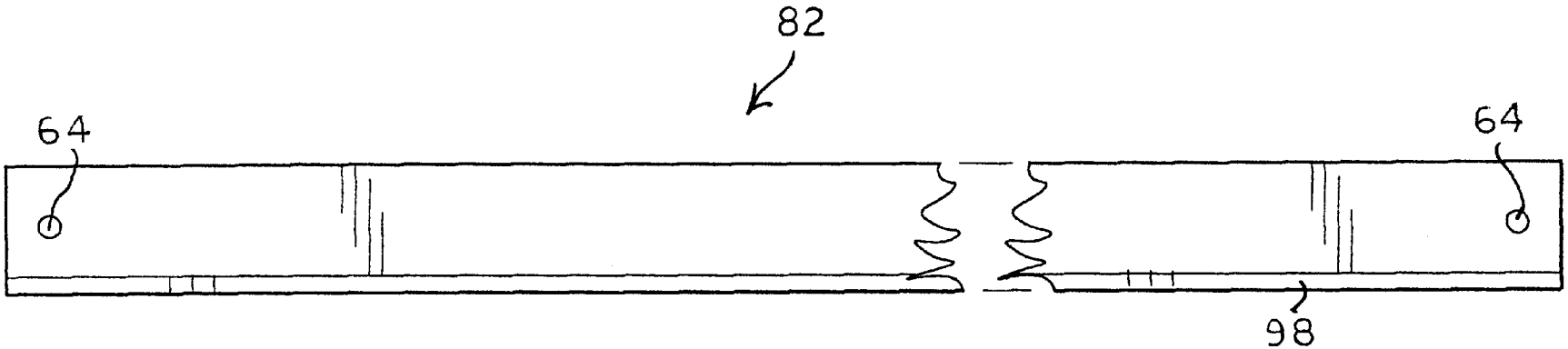
FIG. 14B is a left side top plan view of the bottom rail for the top or king plate.
Figure 14A:
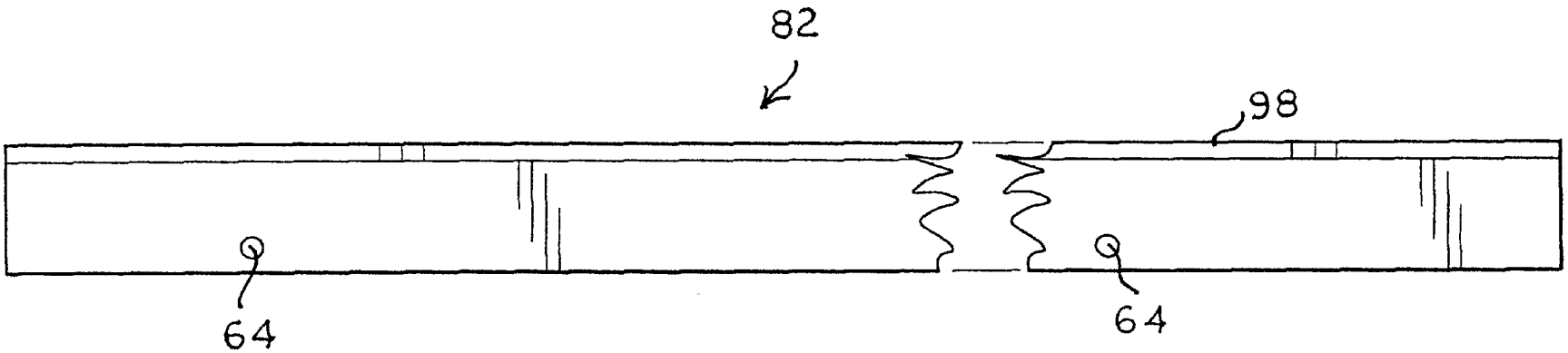
FIG. 14A is a side elevational view of the bottom rail for the top or king plate.
Figure 15:
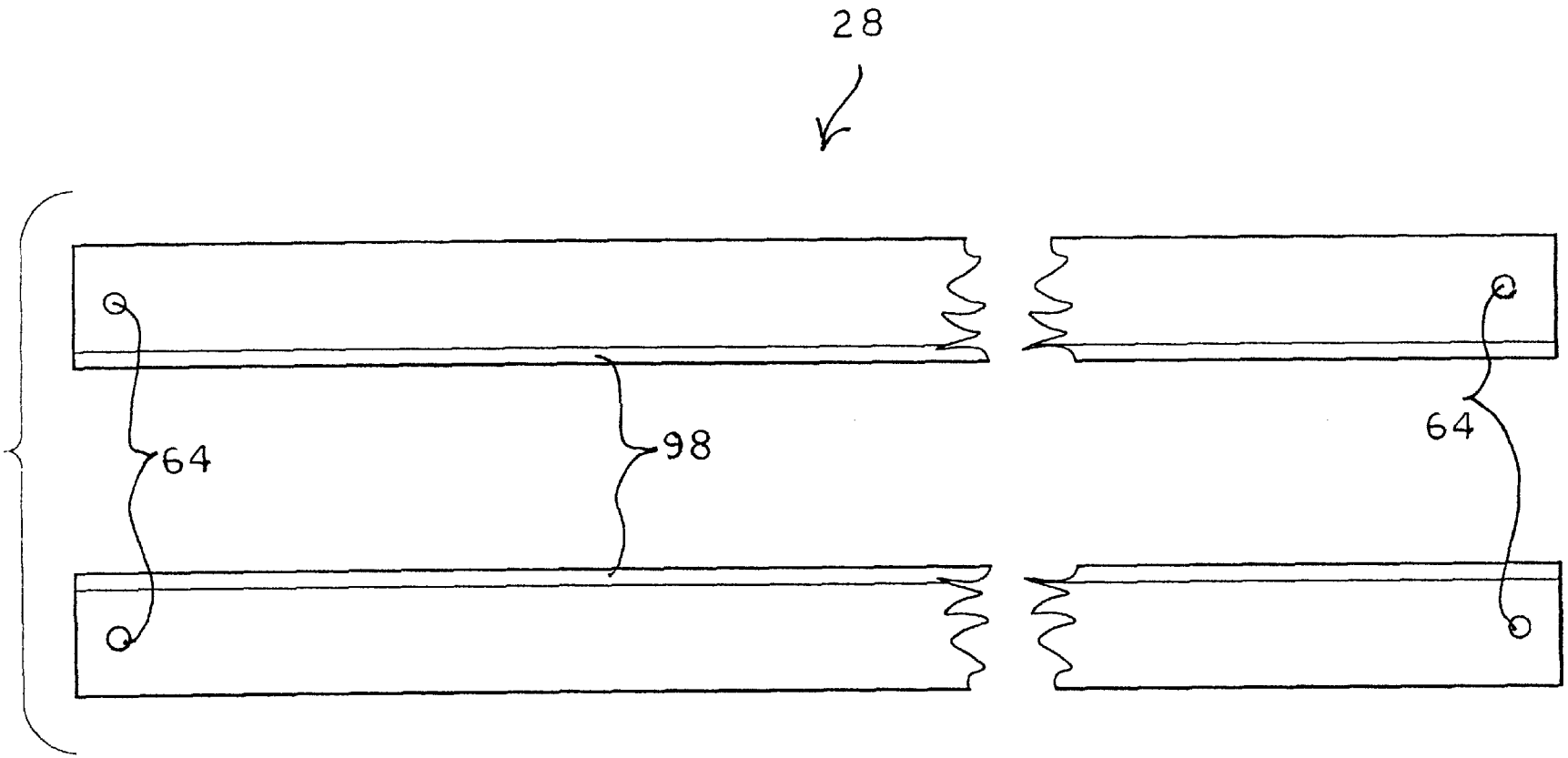
FIG. 15 is a front elevational view of one pair of two pairs of roller height or gauge supports.
Figures 16A, 16B, 16C:
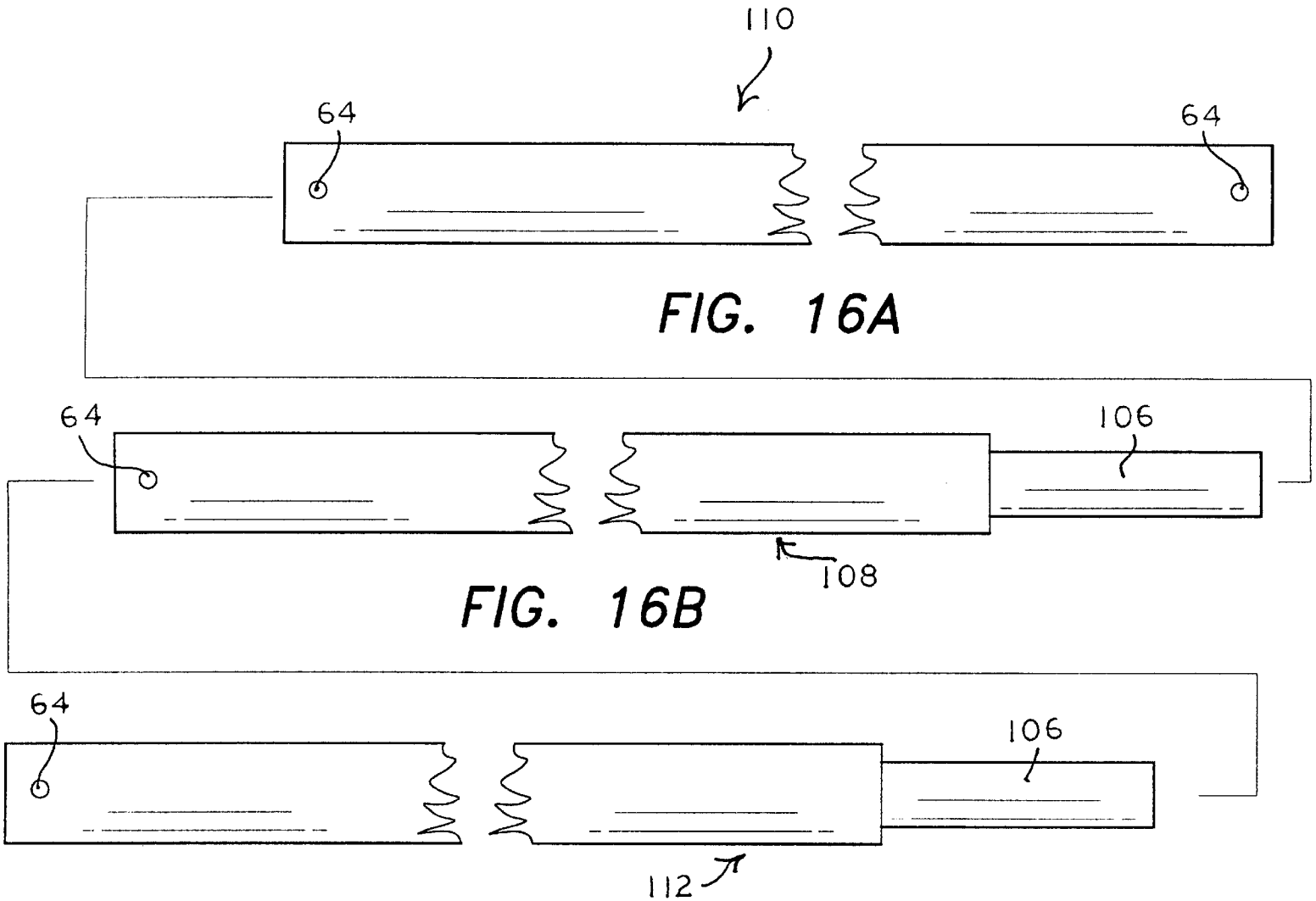
FIG. 16A is a front side elevational view of the main roller.
FIG. 16B is a front side elevational view of the queen extension roller.
FIG. 16C is a front side elevational view of the king extension roller.

FIG. 10A illustrates the main spacer or mid-brace element 56 for the metal frame 22. FIG. 10B shows the stop plate 96 on the queen carriage 24 in FIG. 1. FIG. 11 depicts the left side support or the extending side rail 16 of the base frame 14 shown in FIG. 1. FIGS. 12A and 12B show, respectively, a side view and a top view of the top left rail 94 with an aperture 64 on the left for the stop plate 96 of FIG. 5. FIGS. 13A and 13B show, respectively, top and side views of one of the pair of bottom rails 92 supporting the queen plate 90 of FIG. 5. FIGS. 14A and 14B illustrate a side view and a top view, respectively, of one of a pair of bottom rails for the king plate 82 which are shorter in length than the bottom rails 92 of the queen plate 90. In FIG. 15, one pair of the upright roller support element 28 is shown with the flanges 66 separated for inclusion of the In FIGS. 16A, 16B and 16C, a system of increasing the lengths of the rubber or plastic rollers on metal tubes 106 to accommodate the quilting of blankets for a regular size bed, a queen size bed or a king size is illustrated. The larger queen size bed blanket is accommodated by inserting the queen extension roller 108 (FIG. 16B) and its exposed insert portion 106 into one end of the main regular size bed roller 110 (FIG. 16A). If a king size bed blanket is to be stitched, the king extension roller 112 is added to the queen extension roller 108 via its insert portion 106. The apertures 64 provide securement of each roller segment by pins (not shown here). The metal frame must be enlarged to accommodate the increased roller lengths.

Figure 17A:
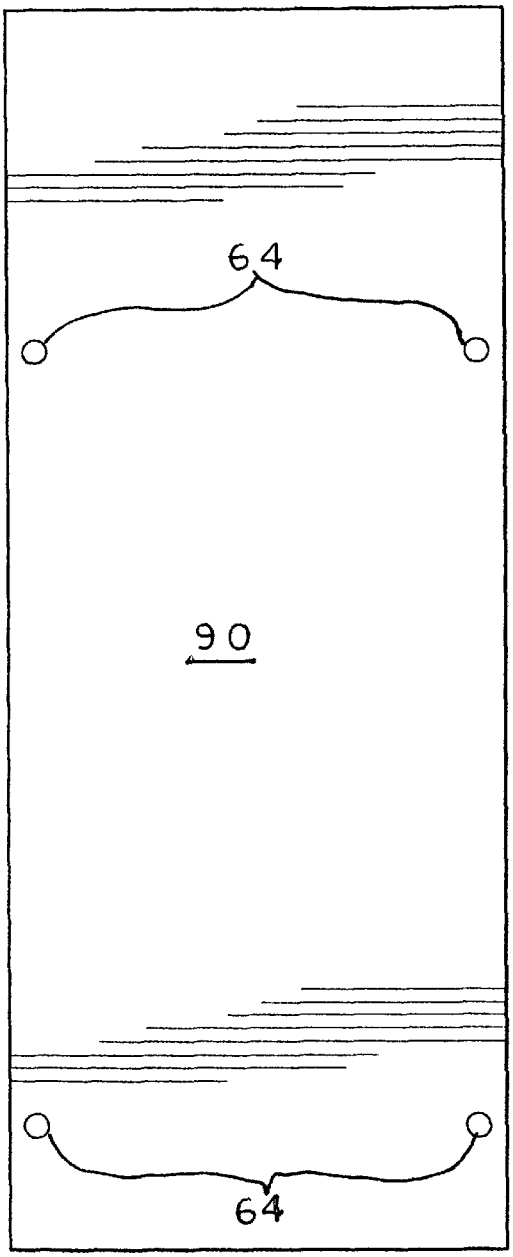
FIG. 17A is a top plan view of the plastic bottom plate.
Figure 17B:
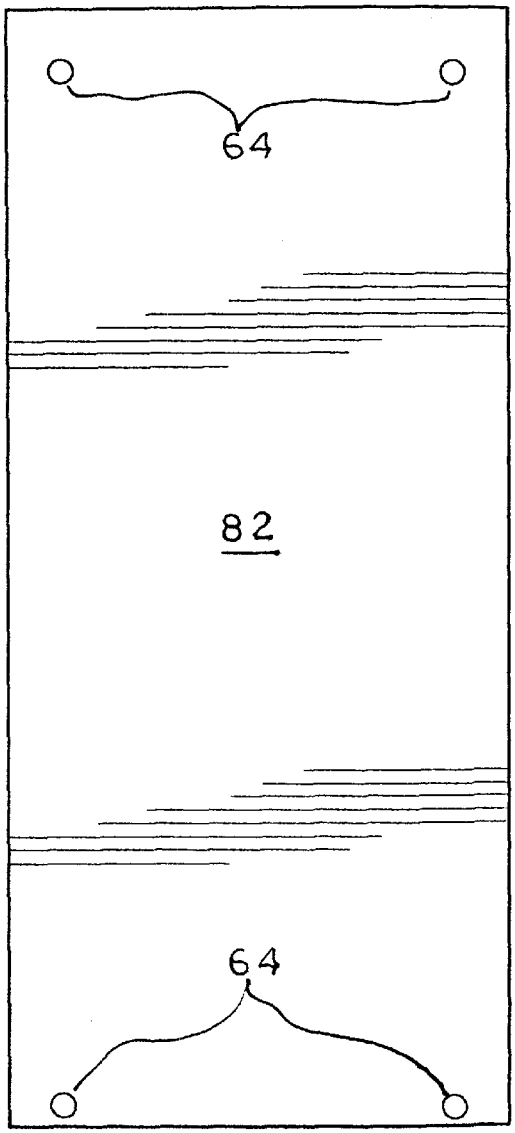
FIG. 17B is a top plan view of the plastic top plate.

FIGS. 17A and 17B, respectively, show the relative sizes of the queen plate 90, e.g., 20 in. by 8 in., and the king plate 82, e.g., 18 in. by 8 in. with appropriate apertures 64. The sizes of the plate rails would have commensurate sizes.

Figure 18:
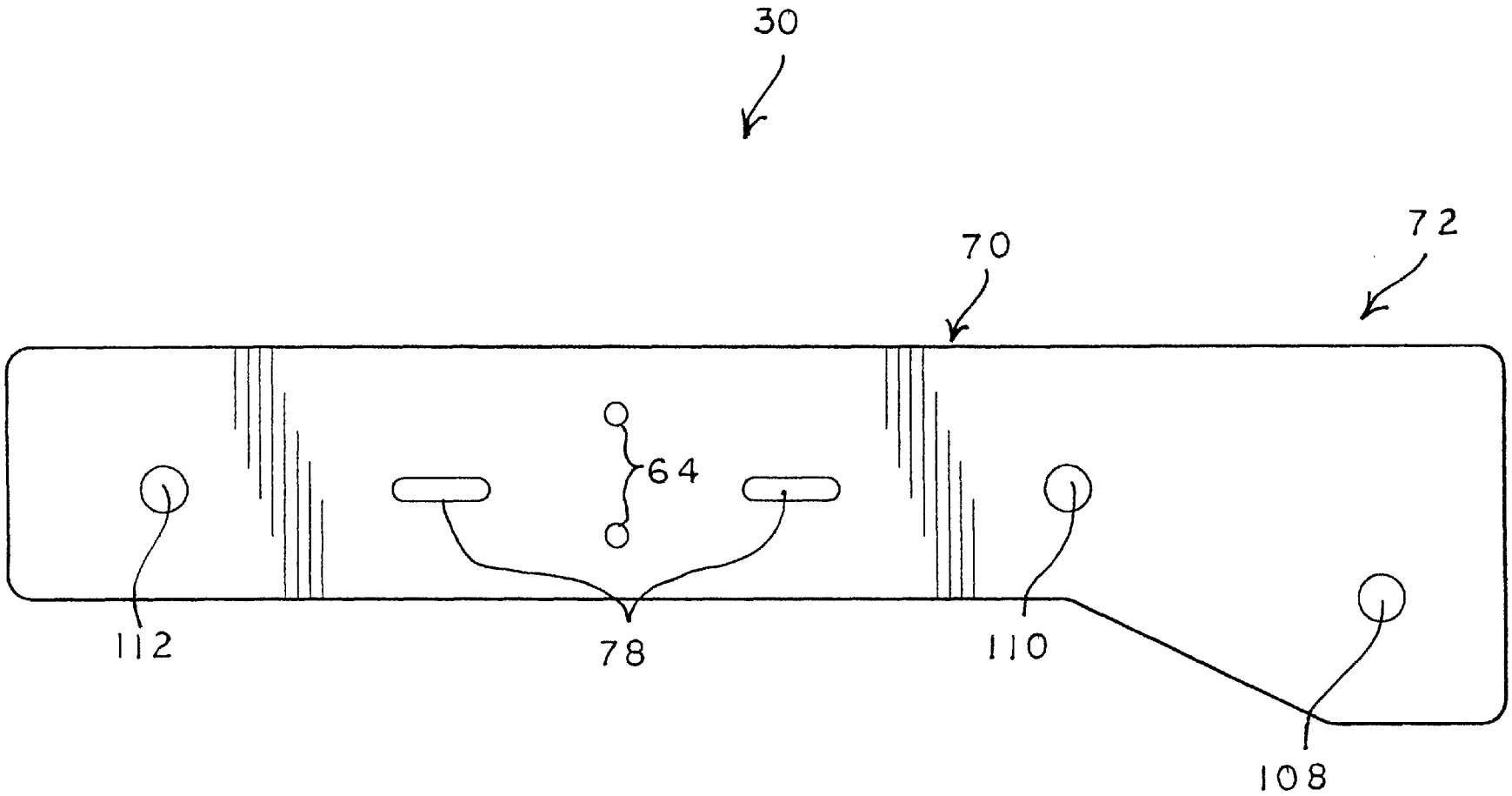
FIG. 18 is a side elevational view of one of a pair of plastic roller supports.

FIG. 18 is the horizontally arranged roller support arm 30 for positioning on each upright roller support element 28 (FIG. 1). Arm 30 is preferably made of white plastic or Teflon (TM) in the shape shown with a straight upper edge 70, an enlarged head 72 for supporting the rear supply roller 32 (not shown) and the tension roller 34 (not shown) in the apertures. The two smaller apertures 64 are for fastening to the upright roller support element 28. The slots 78 are for passing through the straps 46 to pin to the edge of the combined fabric sheet material 38 as seen in FIG. 1.

Thus, a quilting rack having the property of extending the length of the rollers and the size of the frame is advantageous in addition to the moving capacities of the king and queen carriages.

It is to be understood that the present invention is not limited to the embodiment described above, but encompasses any and all embodiments within the scope of the following claims.

I claim:

1. A quilting rack for sewing machines comprising:

a U-shaped metal frame having a pair of extending side rails supporting a front rail and a rear rail to form a rectangular metal frame;

a first rectangular wheeled carriage translatable from side to side from the extending side rails on the rectangular metal frame;

a second rectangular wheeled carriage translatable forward and backward on the first wheeled carriage for supporting a sewing machine;

each of said pair of extending side rails supporting an upright roller support element;

a roller support arm horizontally arranged perpendicularly to each upright roller support element;

a set of three rollers extending between the roller support arms to supply, tension and load a quiltable fabric sheet;

each of said rollers rotatable only in one direction; and a laser pointer device located on said second wheeled carriage;

whereby the quiltable fabric sheet can be patterned by the sewing machine following a pattern stencil illuminated by said laser pointer to stitch a pattern on the movable quiltable fabric sheet.

2. The quilting rack for sewing machines according to claim 1, wherein each horizontal roller support arm is adjustable in height on each upright support element.

3. The quilting rack for sewing machines according to claim 1, wherein each horizontal roller support arm has a pair of straps for tensioning the quiltable fabric from side to side.

4. The quilting rack for sewing machines according to claim 1, wherein a first roller of said set of three rollers supplies the quiltable fabric and is furthest from the sewing machine.

5. The quilting rack for sewing machines according to claim 1, wherein a second roller of said set of three rollers tensions the quiltable fabric and is in front of said first roller.

6. The quilting rack for sewing machines according to claim 1, wherein a third roller of said set of three rollers loads the quilted fabric.

7. The quilting rack for sewing machines according to claim 1, wherein the second rectangular wheeled carriage has four wheels with two wheels on each side traversing parallel side rails of the first rectangular wheeled carriage.

8. The quilting rack for sewing machines according to claim 1, wherein the first rectangular wheeled carriage has four wheels with two wheels on each side traversing the front rail and the rear rail of the pair of extending side rails.

9. The quilting rack for sewing machines according to claim 1, wherein the loading roller and the tension roller rotate in clockwise directions only.

10. The quilting rack for sewing machines according to claim 1, wherein the supply roller rotates in a counter-clockwise direction only.

11. The quilting rack for sewing machines according to claim 1, wherein a set of pawl and gear wheel on each roller on each end controls only one-way rotation of each roller.

12. The quilting rack for sewing machines according to claim 1, wherein a rod at the front edge of the second rectangular wheeled carriage and extending past its sides enables control of the second carriage forward and rearward.

13. A quilting rack for mounting on a shelf comprising:

a U-shaped metal frame having a pair of extending side rails supporting a front rail and a rear rail to form a rectangular metal frame;

a first rectangular wheeled carriage translatable from side to side from the extending side rails on the rectangular metal frame;

a second rectangular wheeled carriage translatable forward and backward on the first wheeled carriage;

each of said pair of extending side rails supporting an upright roller support element;

a roller support arm horizontally arranged perpendicularly to each upright roller support element;

a set of three rollers extending between the roller support arms to supply, tension and load a quiltable fabric sheet;

each of said rollers rotatable only in one direction; and a laser pointer device located on said second wheeled carriage and directed upwards to light a movable pattern stencil for quilting;

whereby the quiltable fabric sheet can be patterned by following the illuminated pattern stencil to hand stitch a pattern on the movable quiltable fabric sheet.

14. The quilting rack according to claim 13, wherein each horizontal roller support arm is adjustable in height on each upright support element.

15. The quilting rack according to claim 13, wherein each horizontal roller support arm has a pair of straps for tensioning the quiltable fabric from side to side.

16. The quilting rack according to claim 13, wherein a first roller of said set of three rollers supplies the quiltable fabric and is located in the rear, a second roller tensions the quiltable fabric and is in front of said first roller, and a third roller located between the first and second rollers loads the quilted fabric.

17. The quilting rack according to claim 16, wherein the supply roller and the tension roller rotate in clockwise directions only, and the loading roller rotates only in a counter-clockwise direction.

18. The quilting rack according to claim 13, wherein a set of a pawl and a gear wheel on each roller on at least one end controls only one-way rotation of each roller.

19. The quilting rack according to claim 13, wherein the second rectangular wheeled carriage has four wheels with two wheels on each side traversing parallel side rails of the first rectangular wheeled carriage, and includes a rod at the front edge of the wheeled carriage and extending past its sides enabling control of the second carriage forward and rearward.

20. The quilting rack according to claim 13, wherein the first rectangular wheeled carriage has four wheels with two wheels on each side traversing the front rail and the rear rail of the pair of extending side rails.

* * * * *